US006002207A

United States Patent [19]

Beeteson et al.

[11] Patent Number: 6,002,207

[45] Date of Patent: Dec. 14, 1999

[54] ELECTRON SOURCE WITH LIGHT SHUTTER DEVICE

[75] Inventors: John Beeteson, Skelmorlie; Andrew Knox, Kilbirnie, both of United Kingdom

[73] Assignee: International Business Machines Corporation, Armonk, N.Y.

[21] Appl. No.: 08/676,854

[22] Filed: Jul. 3, 1996

[30] Foreign Application Priority Data

Aug. 25, 1995 [GB] United Kingdom ..... 9517465
Mar. 6, 1996 [GB] United Kingdom ..... 9604750

[51] Int. Cl.[6] ..... H01J 40/18; H01J 29/68

[52] U.S. Cl. ..... 313/542; 313/543; 313/525; 313/537; 313/422; 315/169.1; 345/75

[58] Field of Search ..... 313/422, 495, 313/496, 497, 525, 537, 540, 543, 336; 315/169.1; 345/74, 75

[56] References Cited

U.S. PATENT DOCUMENTS 4,618,801 10/1986 Kakino ..... 313/495
4,663,559 5/1987 Christensen ..... 313/336
4,763,041 8/1988 Segawa ..... 313/496
5,325,014 6/1994 Murai et al. ..... 313/422
5,473,222 12/1995 Thoeny et al. ..... 315/169.1
5,747,923 5/1998 Beeteson et al. ..... 313/422
5,753,998 5/1998 Beeteson et al. ..... 313/422
5,760,548 6/1998 Beeteson et al. ..... 313/422
5,804,833 9/1998 Stettner et al. ..... 313/336

*Primary Examiner*—Michael Day
*Attorney, Agent, or Firm*—Scully, Scott, Murphy & Presser; Jay P. Sbrollini, Esq.

[57] ABSTRACT

An electron source includes a photocathode (20) for emitting electrons on excitation by incident light radiation. A permanent magnet (60) is perforated by a plurality of channels extending between opposite poles of the magnet (60). The magnet (60) generates, in each channel, a magnetic field which forms electrons received from the photocathode (20) into an electron beam for guidance towards a target (90). A shutter device (22) is provided having an array of addressable shutter elements, each selectively actuable to alternately admit and block passage of light radiation onto the photocathode (20) in response to an address signal.

33 Claims, 9 Drawing Sheets

ELECTRON SOURCE WITH LIGHT SHUTTER DEVICE

BACKGROUND OF THE INVENTION

1. Technical Field

The present invention relates to a magnetic matrix electron source.

A magnetic matrix electron source of the present invention is particularly although not exclusively useful in display applications, especially flat panel display applications. Such applications include television receivers and visual display units for computers, especially although not exclusively portable computers, personal organizers, communications equipment, and the like. Flat panel display devices based on a magnetic matrix electron source of the present invention will hereinafter by referred to as Magnetic Matrix Displays.

2. Prior Art

Conventional flat panel displays, such as liquid crystal display panels, and field emission displays, are complicated to manufacture because they each involve a relatively high level of semiconductor fabrication, delicate materials, and high tolerances.

SUMMARY OF THE INVENTION

In accordance with the present invention, there is now provided an electron source comprising: photocathode means for emitting electrons on excitation by incident light radiation; a permanent magnet perforated by a plurality of channels extending between opposite poles of the magnet, the magnet generating, in each channel, a magnetic field which forms electrons received from the photocathode means into an electron beam for guidance towards a target.

Preferably, the electron source comprises shutter means having an array of addressable shutter elements each selectively actuable to alternately admit and block passage of light radiation onto the photocathode means in response to an address signal.

In preferred embodiments of the present invention, the shutter means comprises a liquid crystal shutter.

Grid electrode means are preferably disposed between the cathode means and the magnet for controlling flow of electrons from the cathode means into each channel. The grid electrode means may be disposed on the surface of the cathode means facing the magnet. Alternatively, the grid electrode means may be disposed on the surface of the magnet facing the cathode means.

The channels are preferably disposed in the magnet in a two dimensional array of rows and columns. In preferred embodiments of the present invention, the grid electrode means comprises a plurality of parallel row conductors and a plurality of parallel column conductors arranged orthogonally to the row conductors, each channel being located at a different intersection of a row conductor and a column conductor.

Each channel may vary in cross-section along its length. Each channel is preferably tapered.

The magnet preferably comprises ferrite. In preferred embodiments of the present invention, the magnet comprises a binder. The binder may comprise silicon dioxide.

In some embodiments of the present invention, each channel is quadrilateral in cross-section. In other embodiments of the present invention, each channel is circular is cross section. The corners and edges of each channel are preferably radiussed.

The magnet may comprise a stack of perforated laminations, the perforations in each lamination being aligned with the perforations in an adjacent lamination to continue the channel through the stack.

Each lamination in the stack may be separated from an adjacent lamination by a spacer.

In preferred embodiments of the present invention, anode means is disposed on the surface of the magnet remote from the cathode for accelerating electrons through the channels. The anode means preferably comprises a plurality of anodes extending parallel to the columns of channels, the anodes comprising pairs of anodes each corresponding to a different column of channels, each pair comprising first and second anodes respectively extending along opposite sides of the corresponding column of anodes, the first anodes being interconnected and the second anodes being interconnected. The first and second anodes may comprise lateral formations surrounding corners of the channels. Particularly preferred embodiments of the present invention comprise means for applying a deflection voltage across the first and second anodes to deflect electron beams emerging from the channels.

The present invention extends to a display device comprising: an electron source as hereinbefore described; a screen for receiving electrons from the electron source, the screen having a phosphor coating facing the side of the magnet remote from the cathode; and means for supplying control signals to the grid electrode means and the anode means to selectively control flow of electrons from the cathode to the phosphor coating via the channels thereby to produce an image on the screen.

The present invention also extends to a display device comprising: an electron source as hereinbefore described; a screen for receiving electrons from the electron source, the screen having a phosphor coating facing the side of the magnet remote from the cathode, the phosphor coating comprising a plurality of groups of different phosphors, the groups being arranged in a repetitive pattern, each group corresponding to a different channel; means for supplying control signals to the grid electrode means and the anode means to selectively control flow of electrons from the cathode to the phosphor coating via the channels thereby to produce an image on the screen; and, deflection means for supplying deflection signals to the anode means to sequentially address electrons emerging from the channels to different ones of the phosphors for the phosphor coating thereby to produce a color image on the screen. Preferably, the phosphors comprise Red, Green, and Blue phosphors. In preferred embodiments of the present invention, the deflection means is arranged to address electrons emerging from the channels to different ones of the phosphors in the repetitive sequence Red, Green, Red, Blue, . . . A final anode layer is preferably disposed on the phosphor coating. The screen may be arcuate in at least one direction and each interconnection between adjacent first anodes and between adjacent second anodes comprises a resistive element. In preferred embodiments of the present invention there is provided means for dynamically varying a DC level applied to the anode means to align electrons emerging from the channels with the phosphor coating on the screen. An aluminum backing may be provided adjacent the phosphor coating.

Viewing the present invention from another aspect, there is now provided a display device comprising: an electron source comprising: photocathode means for emitting electrons on excitation by incident light radiation; a permanent magnet perforated by a plurality of channels extending between opposite poles of the magnet, the magnet generating, in each channel, a magnetic field which forms electrons received from the photocathode means into an electron beam; a screen for receiving electron beams from the electron source, the screen having a phosphor coating facing the side of the magnet remote from the cathode; and, shutter means having an array of addressable shutter elements each selectively actuable in response to alternately admit and block passage of light radiation onto the photocathode means in response to an input video signal.

The present invention further extends to a computer system comprising: memory means; data transfer means for transferring data to and from the memory means; processor means for processing data stored in the memory means; and a display device as hereinbefore described for displaying data processed by the processor means.

Furthermore, the present invention extends to a print-head comprising an electron source as hereinbefore described. Still furthermore, the present invention extends to document processing apparatus comprising such a print-head and means for supplying data to the print-head to produce a printed record in dependence on the data.

Viewing the present invention from yet another aspect, there is now provided a method for generating electron beams comprising: exposing a photocathode to incident light radiation to produce emission of electrons; generating, in each of a plurality of channels extending between opposite poles of a magnet, a magnetic field which forms electrons received from the photocathode into an electron beam for guidance towards a target.

BRIEF DESCRIPTION OF THE DRAWINGS

Preferred embodiments of the present invention will now be described, by way of example only, with reference to the accompanying drawings, in which.

DETAILED DESCRIPTION OF THE PREFERRED EMBODIMETNS OF THE INVENTION

Figure 1:
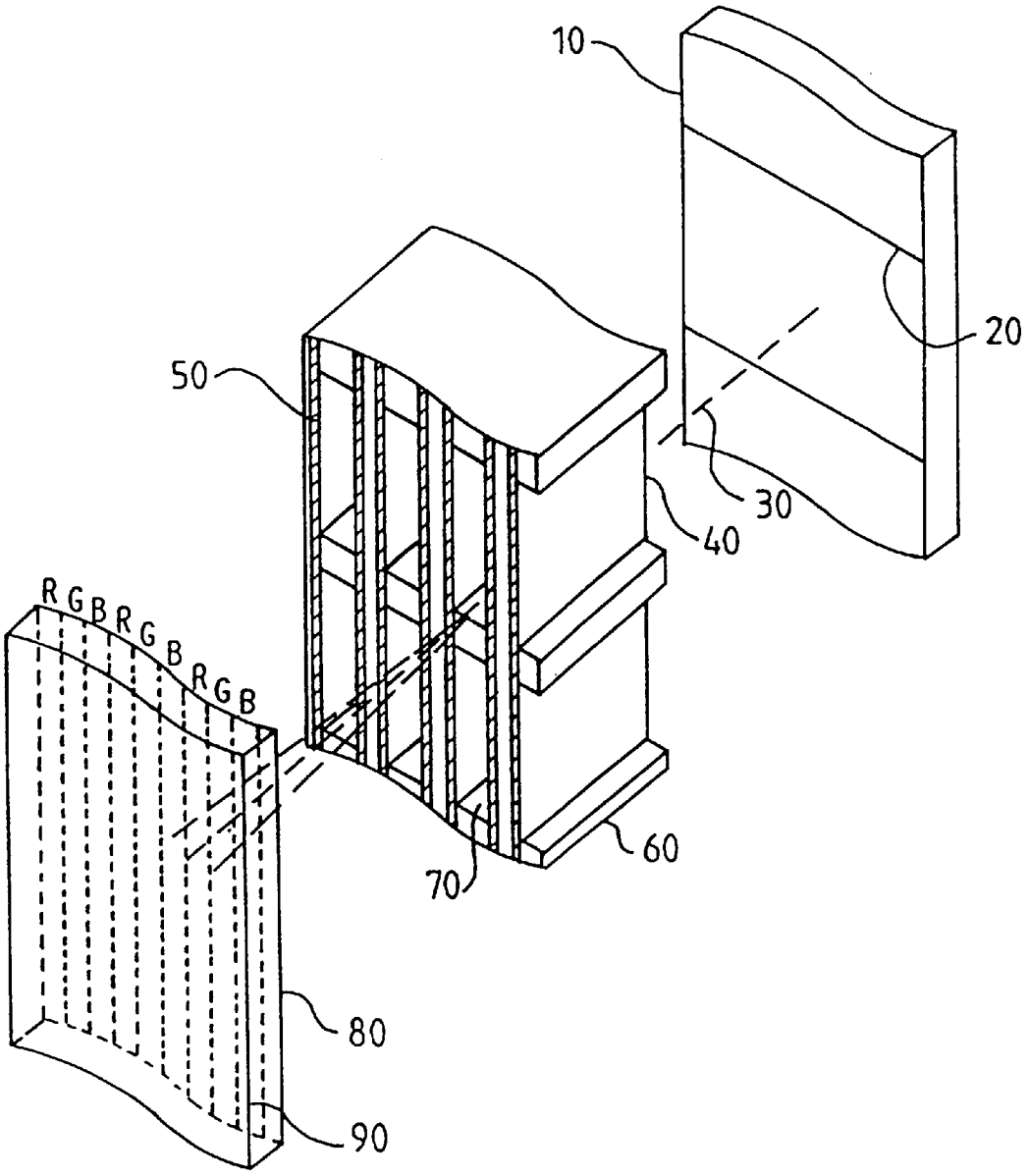
FIG. 1 is an exploded diagram of display apparatus embodying the present invention.

Referring first to FIG. 1, a color magnetic matrix display of the present invention comprises: a first glass plate 10 carrying a cathode 20 and a second glass plate 90 carrying a coating of sequentially arranged red, green and blue phosphor stripes 80 facing the cathode 20. The phosphors are preferably high voltage phosphors. A final anode layer (not shown) is disposed on the phosphor coating 80. A permanent magnet 60 is disposed between glass plates 90 and 10. The magnet is perforated by a two dimension matrix of perforation or "pixel wells" 70. An array of anodes 50 are formed on the surface of the magnet 60 facing the phosphors 80. For the purposes of explanation of the operation of the display, this surface will be referred to as the top of the magnet 60. There is a pair of anodes 50 associated with each column of the matrix of pixel wells 70. The anode of each pair extend along opposite sides of the corresponding column of pixel wells 70. A control grid 40 is formed on the surface of the magnet 60 facing the cathode 20. For the purposes of explanation of the operation of the display, this surface will be referred to as the bottom of the magnet 60. The control grid 40 comprises a first group of parallel control grid conductors extending across the magnet surface in a column direction and a second group of parallel control grid conductors extending across the magnet surface in a row direction so that each pixel well 70 is situated at the intersection of different combination of a row grid conductor and a column grid conductor. As will be described later, plates 10 and 90, and magnet 60 are brought together, sealed and then the whole is evacuated. In operation, electrons are released from the cathode and attracted towards control grid 40. Control grid 40 provides a row/column matrix addressing mechanism for selectively admitting electrons to each pixel well 70. Electrons pass through grid 40 into an addressed pixel well 70. In each pixel well 70, there is an intense magnetic field. The pair of anodes 50 at the top of pixel well 70 accelerate the electrons through pixel well 70 and provide selective sideways deflection of the emerging electron beam 30. Electron beam 30 is then accelerated towards a higher voltage anode formed on glass plate 90 to produce a high velocity electron beam 30 having sufficient energy to penetrate the anode and reach the underlying phosphors 80 resulting ion light output. The higher voltage anode may typically be held at 10 kV.

What follows is a description of the device physics associated with a display of the present invention, in which the following quantities and equations are used:

Charge on an electron: $1.6\times10^{-19}$C

Energy of 1 electron-volt: $1.6\times10^{-19}$J

Rest mass of 1 electron: $9.108\times10^{-31}$Kg

Electron velocity: $v=(2eV/m)^{1/2}$ m/s

Electron kinetic energy: $mv^2/2$

Electron momentum: mv

Cyclotron frequency: f=qB/(2.pi.m) Hz

Figure 2A:
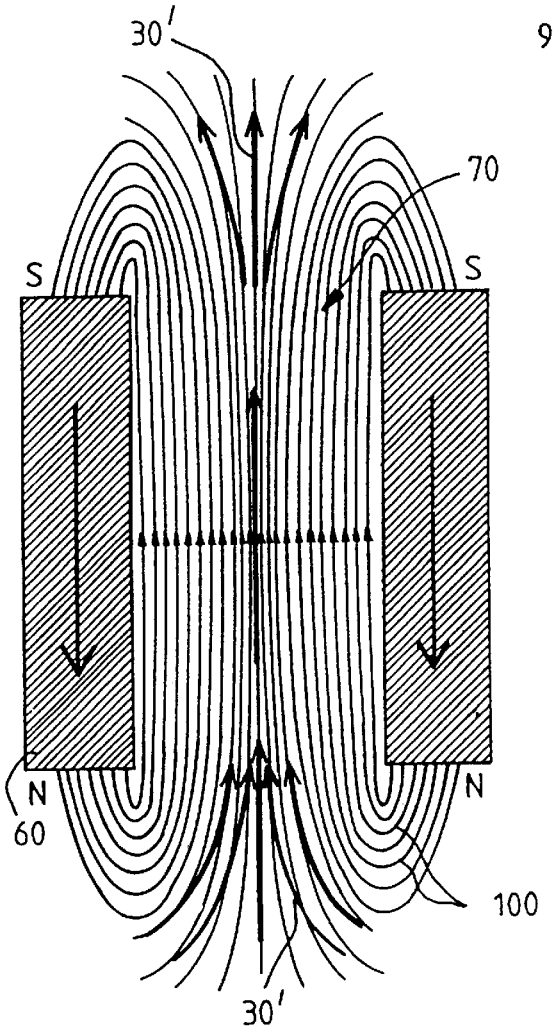
FIG. 2A is a cross-section view through a well of an electron source embodying the present invention to show magnetic field orientation.
Figure 2B:
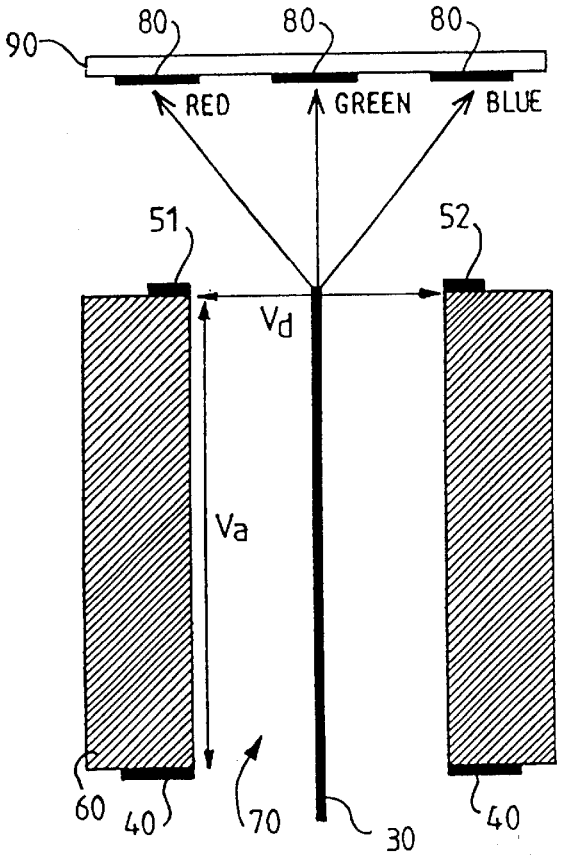
FIG. 2B is a cross-section view through a well of an electron source embodying the present invention to show electric field orientation.

FIG. 2A shows a simplified representation of magnetic fields with associated electron trajectories passing though pixel well 70. FIG. 2B shows a representation of electrostatic fields with associated electron trajectories passing through pixel well 70. An electrostatic potential is applied between the top and bottom of magnet 60 which has the effect of attracting electrons through the magnetic field shown at 100.

At the bottom of the magnetic field 100, by the entrance to pixel well 70, the electron velocity is relatively low (1 eV above the cathode work function represents an electron velocity of around $6\times10^5$ m/s). Electrons 30' in this region can be considered as forming a cloud, with each electron traveling in its own random direction. As the electrons are attracted by the electrostatic field their vertical velocity increases. If an electron is moving in exactly the same direction as the magnetic field 100 there will be no lateral force exerted upon it. The electron will therefore rise through the vacuum following the electric field lines. However, in the more general case the electron direction will not be in the direction of the magnetic field.

Referring now to FIG. 2B, magnetic force acting on a moving electron is perpendicular to both the magnetic field and the velocity of the electron (Flemings right hand rule or $F=e(E+v\times B)$). Thus, in the case of a uniform magnetic field only, the electron will describe a circular path. However, when the electron is also being accelerated by an electric field, the path becomes helical with the diameter of the helix being controlled by the magnetic field strength and the electrons x,y velocity. The periodicity of the helix is controlled by the electrons vertical velocity. A good analogy of this behavior is that of a cork in a whirlpool or dust in a tornado.

By way of summary, electrons enter magnetic field B 100 at the bottom of magnet 60, accelerate through well 70 in magnet 60, and emerge at the top of magnet 60 in a narrow but diverging beam.

Considering now the display as whole rather than a single pixel, the magnetic field B 100 shown in FIG. 2A is formed by a channel or pixel well 70 through a permanent magnet 60. Each pixel requires a separate pixel well 70. Magnet 60 is the size of the display area and is perforated by a plurality of pixel wells 70.

Figure 3:
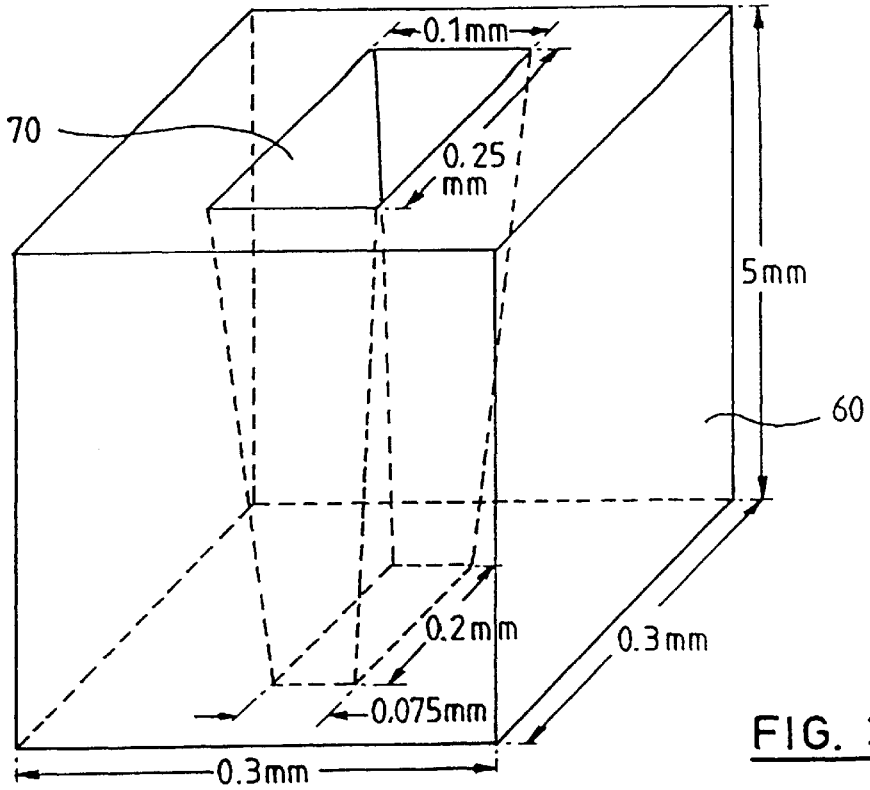
FIG. 3 is an isometric view of a well of an electron source embodying the present invention.

Referring now to FIG. 3, the magnetic field intensity in well 70 is relatively high; the only path for the flux lines to close is either at the edge of magnet 60 or through wells 70. Wells 70 may be tapered, with the narrow end of the taper adjacent cathode 20. It is in this region that the magnetic field is strongest and the electron velocity lowest. Thus efficient electron collection is obtained.

Figure 4A:
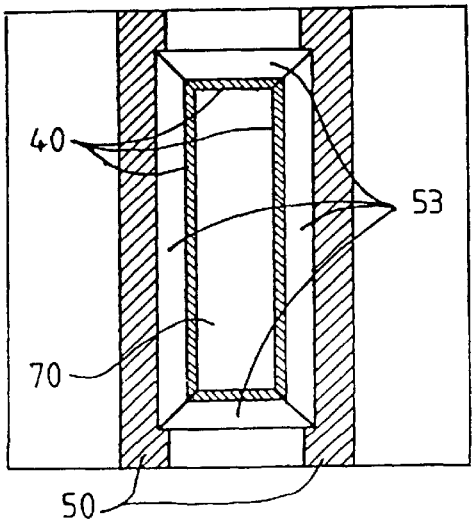
FIG. 4A is a plan view of a well of an electron source embodying the present invention.
Figure 4B:
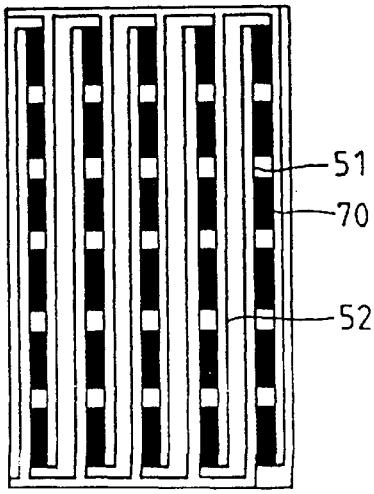
FIG. 4B is a plan view of a plurality of wells of an electron source embodying the present invention.

Referring back to FIG. 2B, electron beam 30 is shown entering an electrostatic field E. As an electron in the beam moves through the field, it gains velocity and momentum. The significance of this increase in the electrons momentum will be discussed shortly. When the electron nears the top of magnet 60, it enters a region influenced by deflection anodes 50. Assuming an anode voltage of 1 kV and a cathode voltage of 0V, the electron velocity at this point is $1.875\times10^7$ m/s or approximately 6% of the speed of light. At the final anode, where the electron velocity is $5.93\times10^7$ m/s or 0.2 c, since the electron has then moved through 10 kV. Anodes 51 and 52 on either side of the exit from the pixel well 70 may be individually controlled. Referring now to FIGS. 4A and 4B, anodes 51 and 52 are preferably arranged in a comb configuration in the interests of easing fabrication. Anodes 51 and 52 are separated from well 70 and grid 40 by insulating regions 53. There are four possible states for anodes 51 and 52, as follows.

1. Anode 51 is OFF; Anode 52 is OFF: In this case there is no accelerating voltage Va between the cathode 20 and the anodes 51 and 52. This state is not used in normal operation of the display.
2. Anode 51 is ON; Anode 52 is ON: In this case there is accelerating voltage $V_a$ symmetrically about the electron beam. The electron beam path is unchanged. When leaving the control anode region the electrons continue until they strike the Green phosphor.
3. Anode 51 is OFF; Anode 52 is ON: In this case there is an asymmetrical control anode voltage $V_d$. The electrons are attracted towards the energized anode 52 (which is still providing an accelerating voltage relative to the cathode 20). The electrons beam is thus electrostatically deflected towards the Red phosphor.
4. Anode 51 is ON; Anode 52 is OFF: This is the opposite to 3. above. In this case, the electron beam is deflected towards the Blue phosphor.

It will be appreciated that other sequences of phosphors may be deposited on the screen with corresponding data re-ordering.

It should also be appreciated that the above deflection technique does not change the magnitude of the electron energy.

As described above, electron beam 30 is formed as electrons move through magnet 60. The magnetic field B 100, although decreasing in intensity still exists above the magnet and in the region of anodes 50. Thus, operation of anodes 50 also requires that they have sufficient effect to drive electron beam 30 at an angle through magnetic field B 100. The momentum change of the electron between the bottom and top of well 70 is of the order of 32× (for a 1 KV anode voltage). The effect of the divergent magnetic field B 100 may be reduced between the bottom and top by a similar amount.

Individual electrons tend to continue traveling in a straight line. However, there are three forces tending to disperse electron beam 30, as follows:

1. The diverging magnetic field B 100 tends to cause electron beam 30 to diverge due to the $v_{xy}$ distribution;
2. The electrostatic field E tends to deflect electron beam 30 towards itself; and,
3. Space charge effects within beam 30 itself cause some divergence.

Figure 5A:
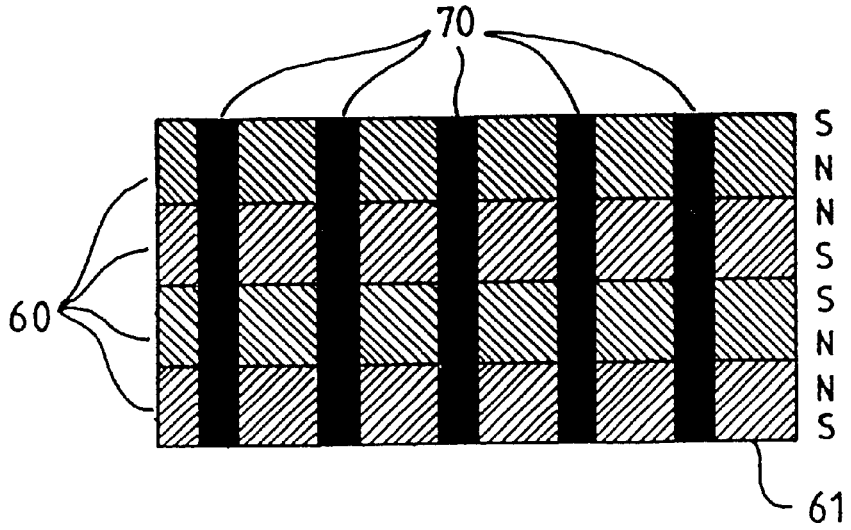
FIG. 5A is a cross section of a stack of magnets of an electron source embodying the present invention.
Figure 5B:
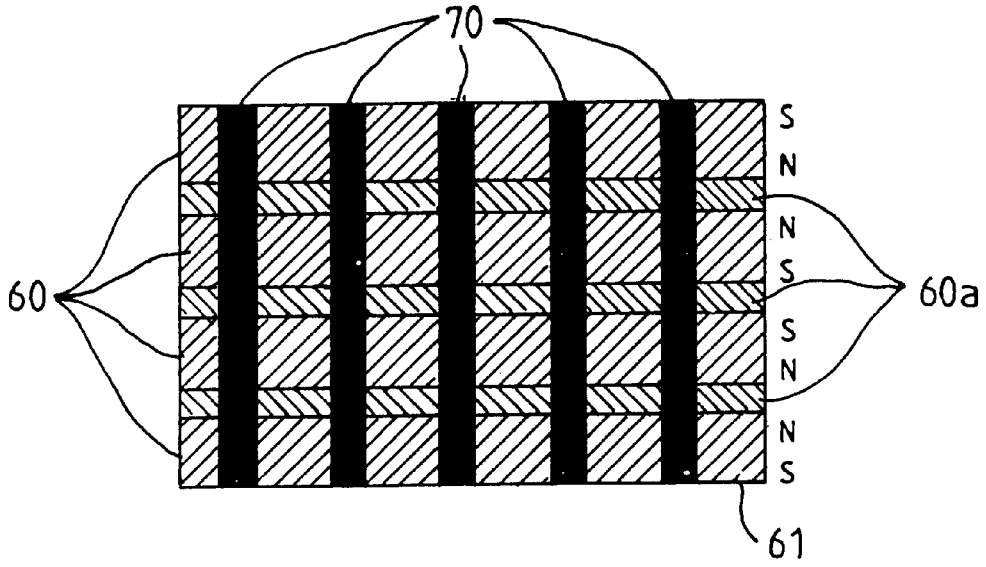
FIG. 5B is a cross section of another stack of magnets of an electron source embodying the present invention.

Referring now to FIG. 5A, in a modification to the example of the preferred embodiment of the present invention hereinbefore described, magnet 60 is replaced by a stack 61 of magnets 60 with like poles facing each other. This produces a magnetic lens in each well 70, thereby aiding beam collimation prior to deflection. This provides additional electron beam focusing. Furthermore, providing the stack 61 consists of one or more pairs of magnets, the helical motion of the electrons is canceled. In some embodiments of the present invention, spacers 60*a* [(not shown)] may be inserted between magnets 60 to improve the lens effect of stack 61.

As mentioned earlier, the display has cathode means 20, grid or gate electrodes 40, and an anode. The arrangement can thus be regarded as a triode structure. Electron flow from cathode means 20 is regulated by grid 40 thereby controlling the current flowing to the anode. It should be noted that the brightness of the display does not depend on the velocity of the electrons but on the quantity of electrons striking phosphor 80.

As mentioned above, magnet 60 acts as a substrate onto which the various conductors required to form the triode are deposited. Deflection anodes 50 are deposited on the top face of magnet 60 and control grid 40 is fabricated on the bottom surface of the magnet 60. Referring back to FIG. 3, it will be appreciated that the dimensions of these conductors are relatively large compared with those employed in current flat panel technologies such as liquid crystal or field emission displays for example. The conductors may advantageously be deposited on magnet 60 by conventional screen printing techniques, thereby leading to lower cost manufacture compared with current flat panel technologies.

Referring back to FIG. 4A, deflection anodes 50 are placed on either side of well 70. In the example hereinbefore described, an anode thickness of 0.01 mm provided acceptable deflection. However, larger dimensions may be used with lower deflection voltages. Deflection anodes 50 may also be deposited to extend at least partially into pixel well 70. It will be appreciated that, in a monochrome example of a display device of the present invention, anode switching or modulation is not required. The anode width is selected to avoid capacitive effects introducing discernible time delays in anode switching across the display. Another factor affecting anode width is current carrying capacity, which is preferably sufficient that a flash-over does not fuse adjacent anodes together and thus damage the display.

In an embodiment of the present invention preferred for simplicity, beam indexing is implemented by alternately switching drive voltages to deflection anodes 50. Improved performance is obtained in another embodiment of the present invention by imposing a modulation voltage on deflection anodes 50. The modulation voltage waveform can be one of many different shapes. However, a sine wave is preferable to reduce back emf effects due to the presence of the magnetic field.

Cathode means 20 may include an array of field emission tips or field emission sheet emitters (amorphous diamond or silicon for example). In such cases, the control grid 40 may be formed on the field emission device substrate. Alternatively, cathode means 20 may include plasma or hot area cathodes, in which cases control grid 40 may be formed on the bottom surface of the magnet as hereinbefore described. An advantage of the ferrite block magnet is that the ferrite block can act as a carrier and support for all the structures of the display that need precision alignment, and that these structures can be deposited by low grade photolithography or screen printing. In yet another alternative embodiment of the present invention, cathode means 20 comprises a photocathode.

As mentioned above, control grid 40 controls the beam current and hence the brightness. In some embodiments of the present invention, the display may be responsive to digital video alone, i.e.: pixels either on or off with no grey scale. In such cases, a single grid 40 provides adequate control of beam current. The application of such displays are however limited and, generally, some form of analog, or grey scale, control is desirable. Thus, in other embodiments of the present invention, two grids are provided; one for setting the black level or biasing, and the other for setting the brightness of the individual pixels. Such a double grid arrangement may also perform matrix addressing of pixels where it may be difficult to modulate the cathode.

A display of the present invention differs from a conventional CRT display in that, whereas in a CRT display only one pixel at a time is lit, in a display of the present invention a whole row or column is lit. Another benefit of the display of the present invention resides in the utilization of row and column drivers. Whereas a typical LCD requires a driver for each of the Red, Green and Blue channels of the display, a display of the present invention uses a single pixel well 70 (and hence grid) for all three colors. Combined with the aforementioned beam indexing, this means that the driver requirement is reduced by a factor of 3 relative to a comparable LCD. A further advantage is that, in active LCDS, conductive tracks must pass between semiconductor switches fabricated on the screen. Since the tracks do not emit light, their size must be limited so as not to be visible to a user. In displays of the present invention, all tracks are hidden either beneath phosphor 80 or on the underside of magnet 60. Due to the relatively large spaces between adjacent pixel wells 70, the tracks can be made relatively large. Hence capacitance effects can be easily overcome.

The relative efficiencies of phosphors 80 at least partially determines the drive characteristics of the gate structure. One way to reduce the voltages involved in operating a beam indexed system is to change the scanning convention. In a preferred embodiment of the present invention, rather than the usual scan of R G B R G B, . . . , the scan is organized so that the most inefficient phosphor is placed in between the two more efficient phosphors in a phosphor stripe pattern. Thus, if the most inefficient phosphor is, for example, Red, the scan follows the pattern B R G R B R G R . . .

In a preferred embodiment of the resent invention, a standing DC potential difference is introduced across deflection anodes 50. The potential can be varied by potentiometer adjustment to permit correction of any residual misalignment between phosphors 80 and pixel wells 70. A two dimensional misalignment can be compensated by applying a varying modulation as the row scan proceeds from top to bottom.

Figure 6A:
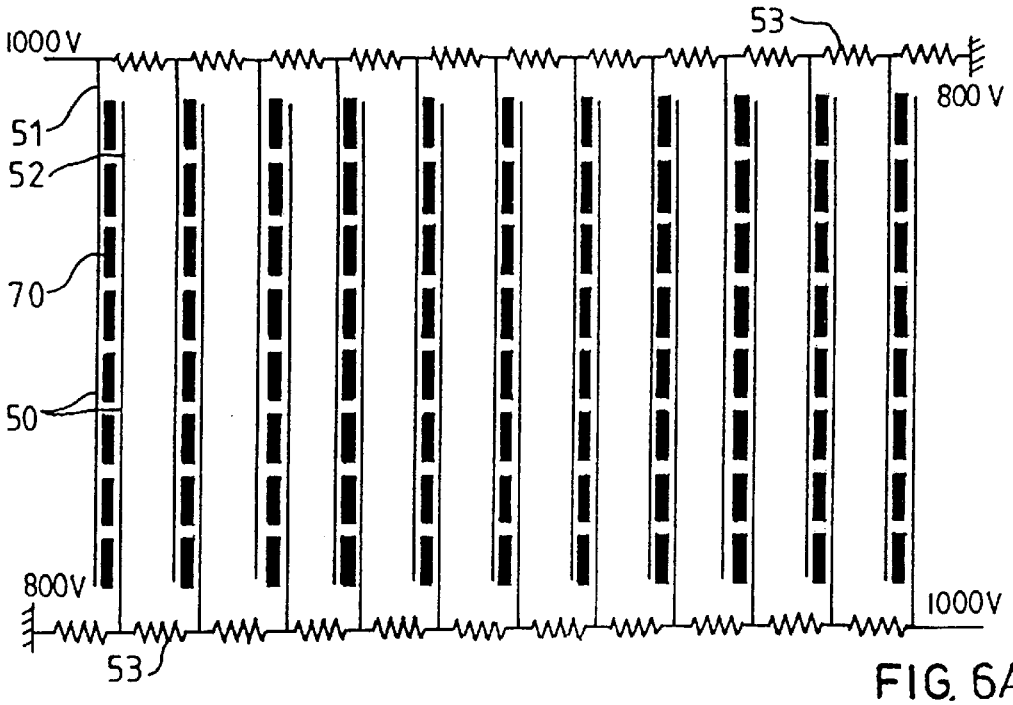
FIG. 6A, is a plan view of a display embodying the present invention.
Figure 6B:
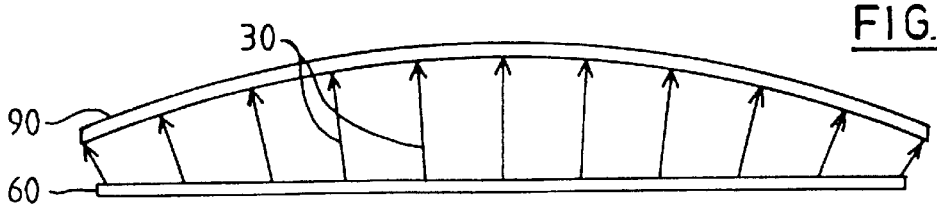
FIG. 6B, is a cross section through the display of FIG. 6A.

Referring now to FIG. 6A, in a preferred embodiment of the present invention, resistive elements 53 between deflection anodes 50 are made resistive. This introduces a slightly different DC potential from the center to the edge of the display. The electron trajectory thus varies gradually in angle as shown in FIG. 6B. This permits a flat magnet 60 to be combined with non-flat glass 90 and, in particular, cylindrical glass. Cylindrical glass is preferable to flat glass because it relieves mechanical stress under atmospheric pressure. Flat screens tend to demand extra implosion protection when used in vacuum tubes.

In a preferred embodiment of the present invention, color selection is performed by beam indexing. To facilitate such beam indexing, the line rate is 3 times faster than normal and the R, G, and B line is multiplexed sequentially. Alternatively, the frame rate may be 3 times faster than usual and field sequential color is employed. It should be appreciated that field-sequential scanning may produce objectionable visual effects to an observer moving relative to the display. Important features of a display of the present invention include the following.

1. Each pixel is generated by a single pixel well 70.
2. The color of a pixel is determined by a relative drive intensity applied to each of the three primary colors.
3. Phosphor 80 is deposited on faceplate 90 in stripes.
4. Primary colors are scanned via a beam index system which is synchronized to the grid control.
5. An electron beam is used to excite high voltage phosphors.
6. Grey-scale is achieved by control of the grid voltage at the bottom of each pixel well (and hence the electron beam density).
7. An entire row or column is addressed simultaneously.
8. If required, the least efficient phosphor 80 can be double scanned to ease grid drive requirements.
9. Phosphor 80 is held at a constant DC voltage.

The above features may provide one or more of the following advantages over conventional flat panel displays.

1. The pixel well concept reduces overall complexity of display fabrication.
2. Whereas in a CRT display, only about 11% of the electron beam current exits the shadow mask to excite the phosphor triads, in a display of the present invention the electron beam current at or near to 100% of the beam current is utilized for each phosphor stripe it is directed at by the beam indexing system. An overall beam current utilization of 33% is achievable, 3 times that achievable in a conventional CRT display.

3. Striped phosphors prevent Moire interference occurring in the direction of the stripes.
4. Control structures and tracks for the beam index system can be easily accommodated in a readily available area on top of the magnet, thereby overcoming a requirement for narrow and precise photolithography as is inherent in conventional LCDs.
5. High voltage phosphors are well understood and readily available.
6. The grid voltage controls an analog system. Thus the effective number of bits for each color is limited only by the DAC used to drive grid 40. Since only one DAC per pixel well row is involved, and the time available for digital to analog conversion is very long, higher resolution in terms of grey-scale granularity is commercially feasible. Thus, the generation of "true color" (24 bits or more) is realizable at relatively low cost.
7. As with conventional LCDs, a display of the present invention uses a row/column addressing technique. Unlike conventional CRT displays however, the excitation time of the phosphor is effectively one third of the line period, e.g.: between 200 and 530 times longer than that for a CRT display for between 600 and 1600 pixels per line resolution. Even greater ratios are possible, especially at higher resolutions. The reason for this is that line and frame flyback time necessary when considering conventional CRT display are not needed for displays of the present invention. The line flyback time alone for a conventional CRT display is typically 20% of the total line period. Furthermore front and back porch times are redundant in displays of the present invention, thereby leading to additional advantage. Further benefits include:
   a) Only one driver per row/column is required ( conventional color LCDs need three);
   b) Very high light outputs are possible. In a conventional CRT display, the phosphor excitation time is much shorter than it's decay time. This means that only one photon per site is emitted during each frame scan. In a display of the present invention, the excitation time is longer than the decay period and so multiple photons per site are emitted during each scan. Thus, a much greater luminous output can be achieved. This is attractive both for projection applications and for displays to be viewed in direct sunlight.
   c) The grid switching speeds are fairly low. It will be appreciated that, in a display of the present invention, the conductors formed on the magnet are operating in a magnetic field. Thus, the conductor inductance gives rise to an unwanted EMF. Reducing the switching speeds reduces the EMF, and also reduces stray magnetic and electric fields.
8. The grid drive voltage is related to the cost of the switching electronics. CMOS switching electronics offers a cheap possibility, but CMOS level signals are also invariably lower than those associated with alternative technologies such as bipolar, for example. Double scanning, e.g.: splitting the screen in half and scanning the two halves in parallel, as is done in LCDs, thus provides an attractively cheap drive technology. Unlike in LCD technology however, double scanning in a display of the present invention doubles the brightness.
9. In low voltage FEDS, phosphor voltages are switched to provide pixel addressing. At small phosphor strip pitches, this technique introduces significant electric field stress between the strips. Medium or higher resolution FEDs may not therefore be possible without risk of electrical breakdown. In displays of the present invention however, the phosphors are held at a single DC final anode voltage as in a conventional CRT display. In preferred embodiments of the present invention, an aluminum backing is placed on the phosphors to prevent charge accumulation and to improve brightness. The electron beams are sufficiently energetic to penetrate the aluminum layer and cause photon emission from the underlying phosphor.

Figure 7:
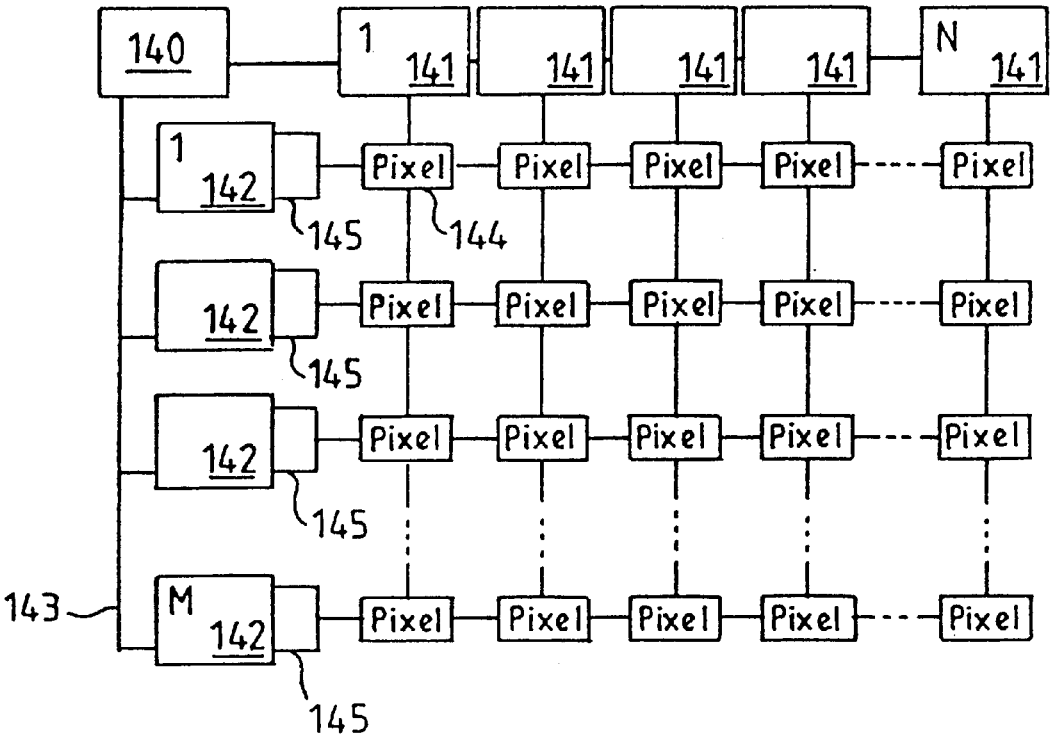
FIG. 7, is a block diagram of an addressing system for a display embodying the present invention.

Referring now to FIG. 7, a preferring matrix addressing system for an N×M pixel display of the present invention comprises an n bit data bus 143. A data bus interface 140 receives input red, green and blue video signals and places them on the data bus in an n bit digital format, where p of each n bits indicates which of the M rows the n bits is addressed to. Each row is provided with an address decoder 142 connected to a q bit DAC 145, where p+q=n. In preferred embodiments of the present invention, q=8. The output of each DAC is connected to a corresponding row conductor of grid 40 associated with a corresponding row of pixels 144. Each column is provided with a column driver 141. The output of each column driver 141 is connected to corresponding column conductor of grid 40 associated with a corresponding column of pixels 144. Each pixel 144 is thus located at the intersection of a different combination of row and column conductors of grid 40.

Figure 8:
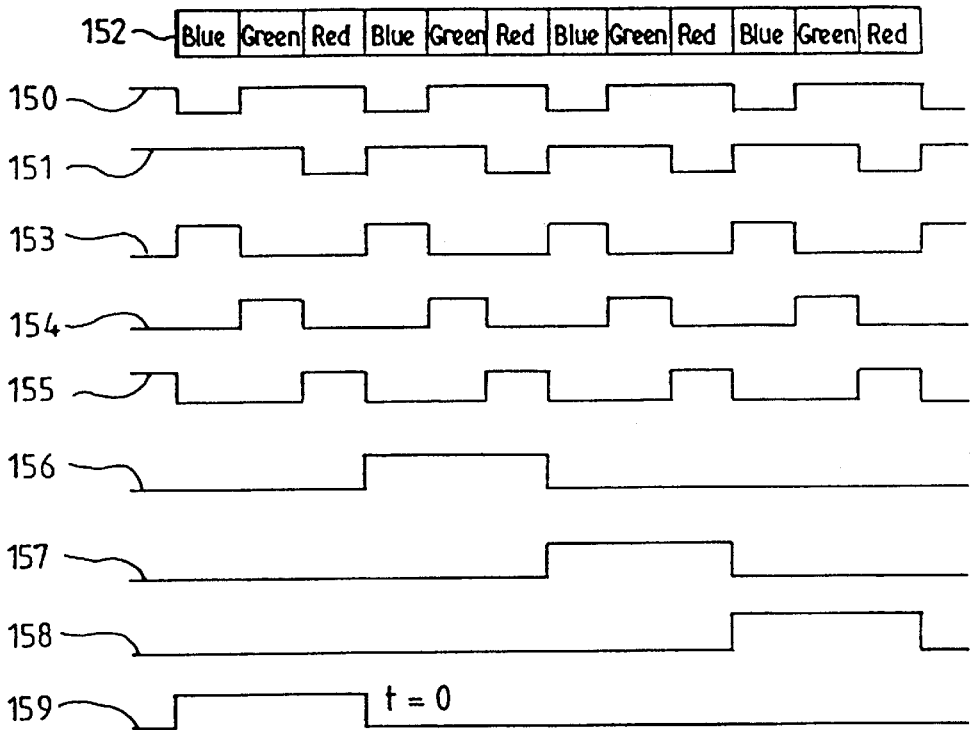
FIG. 8 is a timing diagram corresponding to the addressing system of FIG. 7.

Referring now to FIG. 8, in operation, anodes 51 and 52 are energized with waveforms 150 and 151 respectively to scan electron beam 30 from each pixel well 70 across Red, Green and Blue phosphor stripes 80 in the order shown at 152. Red, Green and Blue video data, represented by waveforms 153, 154, and 155, is sequentially gated onto the row conductors in synchronization with beam indexing waveforms 150 and 151. Column drivers 1, 2, 3 and N generate waveforms 156, 157, 158, and 159 respectively to sequentially select each successive pixel in given row.

Figure 9:
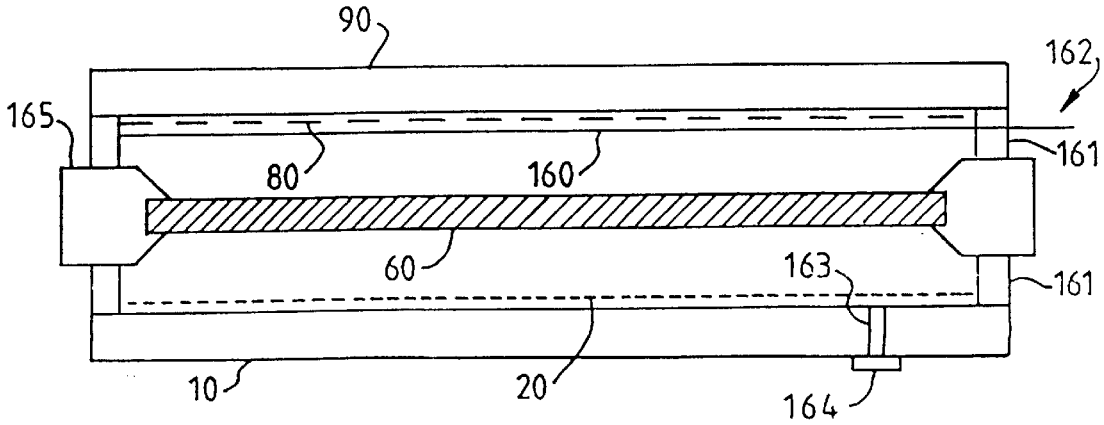
FIG. 9 is a cross section through a display embodying the present invention.

Referring now to FIG. 9, in a preferred embodiment of the present invention in which cathode means 20 is provided by field emission devices. Magnet 60 is supported by glass supports through which connections to the row and column conductors of grid 40 are brought out. A connection 162 to the final anode 160 is brought out via glass side supports 161. The assembly is evacuated during manufacture via exhaust hole 163 which is subsequently capped at 164. A getter may be employed during evacuation to remove residual gases. In small, portable displays of the present invention, faceplate 90 may be sufficiently thin that spacers are fitted to hold faceplate 90 level relative to magnet 60. In larger displays, faceplate 90 can be formed from thicker, self-supporting glass.

Examples of magnetic matrix displays employing the present invention have been hereinbefore described. It will now be appreciated that such displays employ a combination of electrostatic and magnetic fields to control the path of high energy electrons in a vacuum. Such displays have a number of pixels and each is generated by its own site within the display structure. Light output is produced by the incidence of electrons on phosphor stripes. Both monochrome and color displays are possible. An example of a color version uses a switched anode technique as hereinbefore described to perform beam indexing. It will also now be appreciated that the present invention is not limited to display technology in application and may be used in other technologies such as printer technology for example. In particular, it will be appreciated that the present invention can be arranged to act as a print head in document production and/or reproduction apparatus such as printers, copiers, or facsimile machines.

Preferred examples of display devices embodying the present invention in which cathode 20 comprises a photocathode will now be described with reference to FIGS. 10 and 11.

Figure 10:
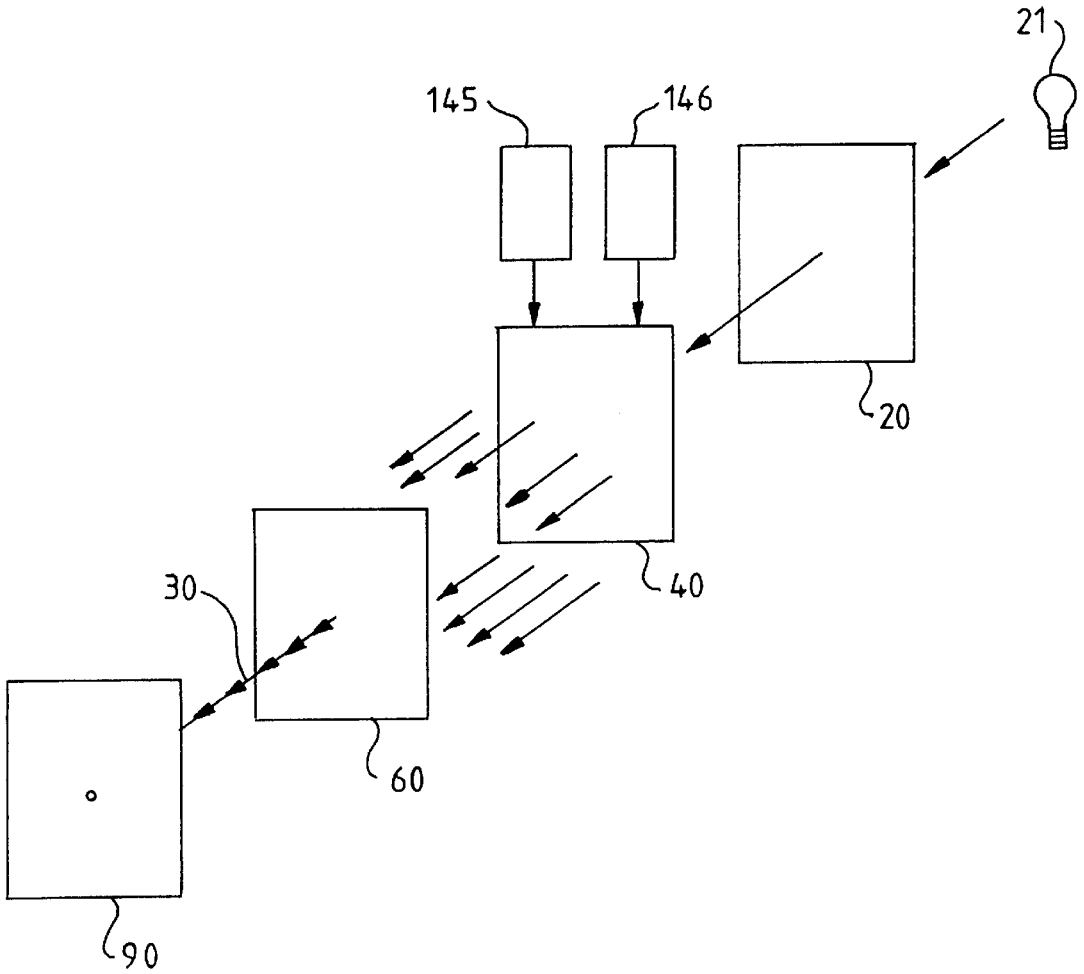
FIG. 10 is a block diagram of a display embodying the present invention having a photocathode; and, FIG. 11 is a block diagram of a display embodying the present invention having a photocathode and a shutter.

Referring to FIG. 10, in a preferred example of a display device embodying the present invention, cathode 20 comprises a plane photocathode. A light source is located on the side of cathode 20 remote from magnet 60. In operation, light emitted from light source 21 energizes cathode 20 to release electrons into the cathode-magnet region of the display device. As hereinbefore described, electrons released into the cathode/magnet region are selected and collected by grid 40. Selected and collected electrons are then accelerated towards a first anode 50 through a two dimensional matrix of wells 70 in magnet 60. Each well contains an intense magnetic field which collimates electrons into a beam 30. Electron emerging from magnet 60 in beam 30 are accelerated towards phosphors on screen 20 by an electric field produced by application of a final anode voltage to a final anode layer on screen 20. Grid 40 comprises first grid conductors and second grid conductors orthogonal to the first grid conductors. Each well 70 is positioned at a different intersection of a first and second grid conductor. Admission of electrons to each well is controlled by the voltages applied to the corresponding pair of first and second grid conductors. As hereinbefore described address circuitry 145 and brightness control circuitry 146 is connected to grid 40. In operation, address circuitry supplies video data to grid 40 to selectively modulate flow of electrons through well 70 to produce an image on screen 90 in response to an input video signal. Brightness control circuit 146 controls the video black level of the display device via grid 40. In some embodiments of the present invention, as hereinbefore described, for each well 70, anode 50 may be divided into first and second anodes to permit deflection of emerging electrons towards different colored phosphors. However, in other embodiments of the present invention, each color pixel sub-pixel of an image may correspond to a different well 70.

Figure 11:
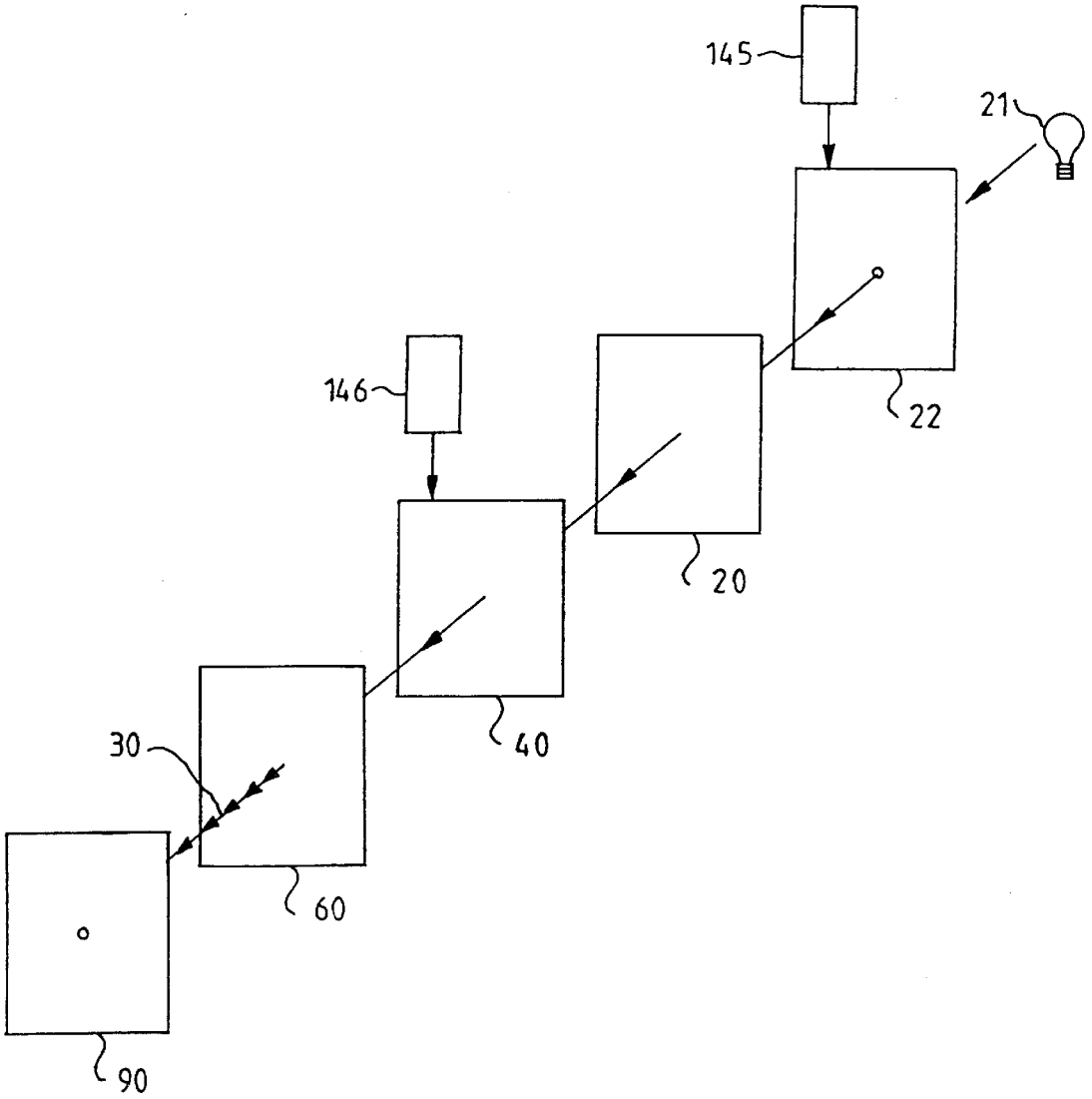

Referring now to FIG. 11, in another preferred example of a display device embodying the present invention, a shutter 22 is disposed between light source 21 and photocathode 20. Shutter 22 has a two-dimensional array of individually addressable shutter elements for alternately admitting and blocking passage of light. Each shutter element corresponds to a different well 70. Address circuitry 145 is connected to shutter 22 and brightness control circuitry 146 is connected to grid 40. In operation, address circuitry selectively opens and closes shutter elements of shutter 22 to selectively admit and block light from light source 21 in response to an input video signal. A video image based on the input video signal is thus projected though shutter 22 onto photocathode 20. Electrons are thus emitted from cathode 20 only from those areas illuminated by the video image. Wells 70 in magnet 60 collimate the electrons emitted from cathode 20 into electron beams. The video image is recreated on screen 90 by light output in response to excitation of the phosphor coating by the incident electron beams. The black level of the video image is controlled by brightness control circuit 146 connected to grid 40. Because only the brightness control circuitry is connected to grid 40, the electronics associated with wells 70 is greatly simplified. The embodiment the present invention hereinbefore described with reference to FIG. 11 is suitable for display of a monochrome image. However, it will be appreciated that the embodiment may be modified to produce a color display by driving shutter 22 with sequential color video data and correspondingly applying beam indexing deflection voltage to deflection anodes 51 and 52 as hereinbefore described. The embodiments of the present invention described with reference to FIGS. 10 and 11 offer improvements over conventional liquid crystal display technology in that they provide higher light output and increased viewing angle. It will be appreciated that the video image produced by shutter 22 may be optically imaged onto cathode 20 to produce an dimensionally modified output picture. Shutter 22 may comprise a liquid crystal display panel, dynamic mirror device, or the like.

Although preferred embodiments of the present invention including a photocathode have been hereinbefore described with reference to display devices, it will be appreciated that the examples of the present invention including a photocathode may also be applicable to other fields, such as printing and photo-lithography for example.

While the invention has been particularly shown and described with respect to preferred embodiments thereof, it will be understood by those skilled in the art that the foregoing and other changes in form and details may be made therein without departing from the spirit and scope of the invention.

Having thus described our invention, what we claim as new, and desire to secure by Letters Patents is:

1. An electron source comprising: photocathode means for emitting electrons on excitation by incident light radiation; a permanent magnet perforated by a plurality of channels extending between opposite poles of the magnet, the magnet generating, in each channel, a magnetic field which forms electrons received from the photocathode means into an electron beam for guidance towards a target; and, shutter means having an array of addressable shutter elements each selectively actuable to alternately admit and block passage of light radiation onto the photocathode means in response to an address signal.

2. An electron source as claimed in claim 1, wherein the shutter means comprises a liquid crystal shutter.

3. An electron source as claimed in claim 1, comprising grid electrode means disposed between the cathode means and the magnet for controlling flow of electrons from the cathode means into each channel.

4. An electron source as claimed in claim 3, wherein the grid electrode means is disposed on the surface of the cathode means facing the magnet.

5. An electron source as claimed in claim 3, wherein the grid electrode means is disposed on the surface of the magnet facing the cathode means.

6. An electron source as claimed in claim 1, wherein the channels are disposed in the magnet in a two dimensional array of rows and columns.

7. An electron source as claimed in claim 6, wherein the grid electrode means comprises a plurality of parallel row conductors and a plurality of parallel column conductors arranged orthogonally to the row conductors, each channel being located at a different intersection of a row conductor and a column conductor.

8. An electron source as claimed in claim 1, wherein each channel varies in cross-section along its length.

9. An electron source as claimed in claim 8, wherein the each channel is tapered.

10. An electron source as claimed in claim 1, wherein the magnet comprises ferrite.

11. An electron source as claimed in claim 10, wherein the magnet comprises a binder.

12. An electron source as claimed in claim 11, wherein the binder comprises silicon dioxide.

13. An electron source as claimed in claim 1, wherein each channel is quadrilateral in cross-section.

14. An electron source as claimed in claim 13, wherein each channel is square in cross-section.

15. An electron source as claimed in claim 14, wherein the corners and edges of each channel are radiussed.

16. An electron source as claimed in claim 13, wherein the corners and edges of each channel are radiussed.

17. An electron source as claimed in claim 1, wherein each channel is circular in cross-section.

18. An electron source as claimed in claim 1, wherein the magnet comprises a stack of perforated laminations, the perforations in each lamination being aligned with the perforations in an adjacent lamination to continue the channel through the stack.

19. An electron source as recited in claim 18, wherein each lamination in the stack is separated from an adjacent lamination by a spacer.

20. An electron source as claimed in claim 1, comprising anode means disposed on the surface of the magnet remote from the cathode for accelerating electrons through the channels.

21. An electron source as claimed in claim 20, wherein the anode means comprises a plurality of anodes extending parallel to the columns of channels, the anodes comprising pairs of anodes each corresponding to a different column of channels, each pair comprising first and second anodes respectively extending along opposite sides of the corresponding column of anodes, the first anodes being interconnected and the second anodes being interconnected.

22. An electron source as claimed in claim 21, wherein the first and second anodes comprise lateral formations surrounding corners of the channels.

23. An electron source as claimed in claim 22, comprising means for applying a deflection voltage across the first and second anodes to deflect electron beams emerging from the channels.

24. A display device comprising: an electron source as claimed in claim 23; a screen for receiving electrons from the electron source, the screen having a phosphor coating facing the side of the magnet remote from the cathode, the phosphor coating comprising a plurality of groups of different phosphors, the groups being arranged in a repetitive pattern, each group corresponding to a different channel; means for supplying control signals to the grid electrode means and the anode means to selectively control flow of electrons from the cathode to the phosphor coating via the channels thereby to produce an image on the screen; and, deflection means for supplying deflection signals to the anode means to sequentially address electrons emerging from the channels to different ones of the phosphors for the phosphor coating thereby to produce a color image on the screen.

25. A display device as claimed in claim 24, wherein the phosphors comprise Red, Green, and Blue phosphors.

26. A display device as claimed in claim 25, wherein the deflection means is arranged to address electrons emerging from the channels to different ones of the phosphors in the repetitive sequence Red, Green, Red, Blue.

27. A display device as claimed in claim 24, comprising a final anode layer disposed on the phosphor coating.

28. A display device as claimed in claim 24, wherein the screen is arcuate in at least one direction and each interconnection between adjacent first anodes and between adjacent second anodes comprises a resistive element.

29. A display device as claimed in claim 24, comprising means for dynamically varying a DC level applied to the anode means to align electrons emerging from the channels with the phosphor coating on the screen.

30. A display device as claimed in claims 24, comprising an aluminum backing adjacent the phosphor coating.

31. A display device comprising: an electron source as claimed in claim 20; a screen for receiving electrons from the electron source, the screen having a phosphor coating facing the side of the magnet remote from the cathode; and means for supplying control signals to the grid electrode means and the anode means to selectively control flow of electrons from the cathode to the phosphor coating via the channels thereby to produce an image on the screen.

32. A display device comprising: an electron source comprising: photocathode means for emitting electrons on excitation by incident light radiation; a permanent magnet perforated by a plurality of channels extending between opposite poles of the magnet, the magnet generating, in each channel, a magnetic field which forms electrons received from the photocathode means into an electron beam; a screen for receiving electron beams from the electron source, the screen having a phosphor coating facing the side of the magnet remote from the cathode; and, shutter means having an array of addressable shutter elements each selectively actuable to alternately admit and block passage of light radiation onto the photocathode means in response to an input video signal.

33. A method for generating electron beams comprising: exposing a photocathode to incident light radiation by selectively actuating each of an array of addressable shutter elements to alternately admit and block passage of light radiation onto the photocathode in response to an address signal to thereby produce emission of electrons; and, generating, in each of plurality of channels extending between opposite poles of a magnet, a magnetic field which forms electrons received from the photocathode into an electron beam for guidance towards a target.

* * * * *